US010797459B2

(12) United States Patent
Donati et al.

(10) Patent No.: US 10,797,459 B2
(45) Date of Patent: Oct. 6, 2020

(54) TOOL FOR CONNECTING AND DISCONNECTING PAIR OF CONNECTORS

(71) Applicant: CommScope Technologies LLC, Hickory, NC (US)

(72) Inventors: Luca Donati, Faenza (IT); Lorenzo Albonetti, Tredozio (IT)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/667,282

(22) Filed: Oct. 29, 2019

(65) Prior Publication Data

US 2020/0176942 A1 Jun. 4, 2020

Related U.S. Application Data

(60) Provisional application No. 62/772,983, filed on Nov. 29, 2018.

(51) Int. Cl.
*H01R 43/26* (2006.01)
*B25B 27/02* (2006.01)

(52) U.S. Cl.
CPC ..... *H01R 43/26* (2013.01); *B25B 27/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,632,056 | A * | 5/1997 | Hsiao | B62J 9/40 7/138 |
| 6,131,494 | A * | 10/2000 | Quenneville | B25B 13/02 81/125.1 |
| 7,534,128 | B2 | 5/2009 | Caveney et al. | |
| 7,901,237 | B2 * | 3/2011 | Abe | H01R 43/26 439/354 |
| 9,048,580 | B2 * | 6/2015 | Chien | H01R 13/6272 |
| 9,239,437 | B2 | 1/2016 | Belenkiy et al. | |
| 2014/0331464 | A1 | 11/2014 | Jiang et al. | |
| 2019/0293276 | A1 * | 9/2019 | Pearson | F21V 21/14 |

OTHER PUBLICATIONS

International Searching Authority, "International Search Report and Written Opinion from PCT Application No. PCT/US2019/058540", from Foreign Counterpart to U.S. Appl. No. 16/667,282, dated Feb. 12, 2020, pp. 1-9, Published: WO.

* cited by examiner

*Primary Examiner* — Phung-Hoang J Nguyen
(74) *Attorney, Agent, or Firm* — Fogg & Powers LLC

(57) ABSTRACT

A tool for connecting and disconnecting a pair of connectors is provided. The tool has a body. The body includes a first edge that is spaced from a second edge. A first portion of the body that includes the first edge is positioned at a first angle in relation to a second portion of the body that includes the second edge. The first edge has a first pair of spaced guide grooves and the second edge has a second pair of spaced guide grooves. The first pair of spaced grooves and the second pair of spaced grooves are configured to selectively receive portions of a cable and portions of component connectors.

20 Claims, 7 Drawing Sheets

TOOL FOR CONNECTING AND DISCONNECTING PAIR OF CONNECTORS

CROSS-REFERENCE TO RELATED APPLICATIONS

This Application claims priority to U.S. Provisional Application Ser. No. 62/772,983, same title herewith, filed on Nov. 29, 2018, which is incorporated in its entirety herein by reference.

BACKGROUND

Wireless cellular service providers use base stations to implement wireless communication links with user equipment, such as mobile phones. In particular, a base station is typically in communication with one or more antennas that receive and transmit radio frequency signals to and from user equipment. Each base station in turn is in communication with the service provider's core network. The coverage area of a base station is limited by the transmit power of the associated signals. Moreover, the coverage provided by the transmitted signals is influenced by many other factors such as physical obstacles and interference. Hence, wireless coverage in buildings and stadiums has been traditionally poor when served only from conventional "macro" base stations.

One way that a wireless cellular service provider can improve the coverage provided by a given base station or group of base stations is by using a distributed antenna system (DAS). In a typical DAS, radio frequency (RF) signals are transported between a master unit and one or more remote antenna units using one or more transport cables. The master unit is communicatively coupled to one or more base stations.

Traditionally, RF signals transmitted from the base stations (also referred to here as "downlink RF signals") are received at the master unit. The master unit uses the downlink RF signals to generate one or more downlink transport signals that are distributed to one or more of the remote antenna units over the transport cables. Each such remote antenna unit receives a downlink transport signal and generates a version of the downlink RF signals based on the downlink transport signal and causes the generated downlink RF signals to be radiated from at least one antenna coupled to or included in that remote antenna unit. A similar process is performed in the uplink direction. RF signals (also referred to here as "uplink RF signals") are transmitted from user equipment. Each such uplink RF signal is intended for a base station coupled to the master unit. Each remote antenna unit receives uplink RF signals transmitted from user equipment within its associated coverage area.

Each remote antenna unit uses the received uplink RF signals to generate an uplink transport signal that is transmitted from the remote antenna unit to the master unit. The master unit receives uplink transport signals from the various remote antenna units coupled to it. For each base station coupled to the master unit, the master unit combines uplink signals intended for that base station that are received from the various remote antenna units.

For each base station coupled to the master unit, the master unit ultimately generates uplink RF signals from the combined uplink signals for that base station, which are provided to that base station. Each remote antenna unit can be coupled to each master unit either directly or indirectly via one or more intermediate devices (such as another remote antenna unit or an expansion unit). In this way, the coverage of each base station can be expanded using the DAS.

SUMMARY

The following summary is made by way of example and not by way of limitation. It is merely provided to aid the reader in understanding some of the aspects of the subject matter described. Embodiments provide a tool to simultaneously connect and disconnect U-turn cables and the like from component connectors.

In one embodiment, a tool for connecting and disconnecting a pair of connectors is provided. The tool has a body. The body includes a first edge that is spaced from a second edge. A first portion of the body that includes the first edge is positioned at a first angle in relation to a second portion of the body that includes the second edge. The first edge has a first pair of spaced guide grooves and the second edge has a second pair of spaced guide grooves. The first pair of spaced grooves and the second pair of spaced grooves are configured to selectively receive portions of a cable and portions of component connectors.

In another example embodiment, a tool for connecting and disconnecting a U-turn cable from a component is provided. The tool includes a body. The body includes a first edge that is spaced from a second edge. A first portion of the body that includes the first edge is positioned at a select first angle in relation to a second portion of the body that includes the second edge. The first edge has a first pair of spaced guide grooves. The second edge has a second pair of spaced guide grooves. The first pair of spaced grooves and the second pair of spaced grooves are configured to selectively receive portions of a cable of the U-turn cable and portions of component connectors. An engaging flange extends from a surface of the body. The engaging flange provides a surface to manipulate the tool.

In yet another embodiment, a method of manipulating a U-turn cable having a pair of cable connectors is provided. The method includes when coupling the pair of cable connectors to an associated pair of component connectors of a component, aligning each cable connector of the pair of cable connectors with an associated component connector of the pair of component connectors; positioning a pair of spaced guide grooves in an end edge of a tool around portions of the U-turn cable near the pair of cable connectors; and asserting a force on the tool towards the cable connectors to simultaneously engage and force connecting portions of the cable connectors to establish a communicative coupling with associated connecting portions of the component connectors.

BRIEF DESCRIPTION OF THE DRAWINGS

In accordance with common practice, the various described features are not drawn to scale but are drawn to emphasize specific features relevant to the subject matter described. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the embodiments, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

This document describes embodiments of a tool to connect and disconnect a pair of cable connectors from a pair of component connectors. The connectors may include quick connect radio frequency (RF) connectors, such as but not limited to, QMA connectors. The tool is useful when connecting and disconnecting U-turn cables and the like from a component such as a remote antenna unit of a distribute antenna system (DAS).

Figure 1A:
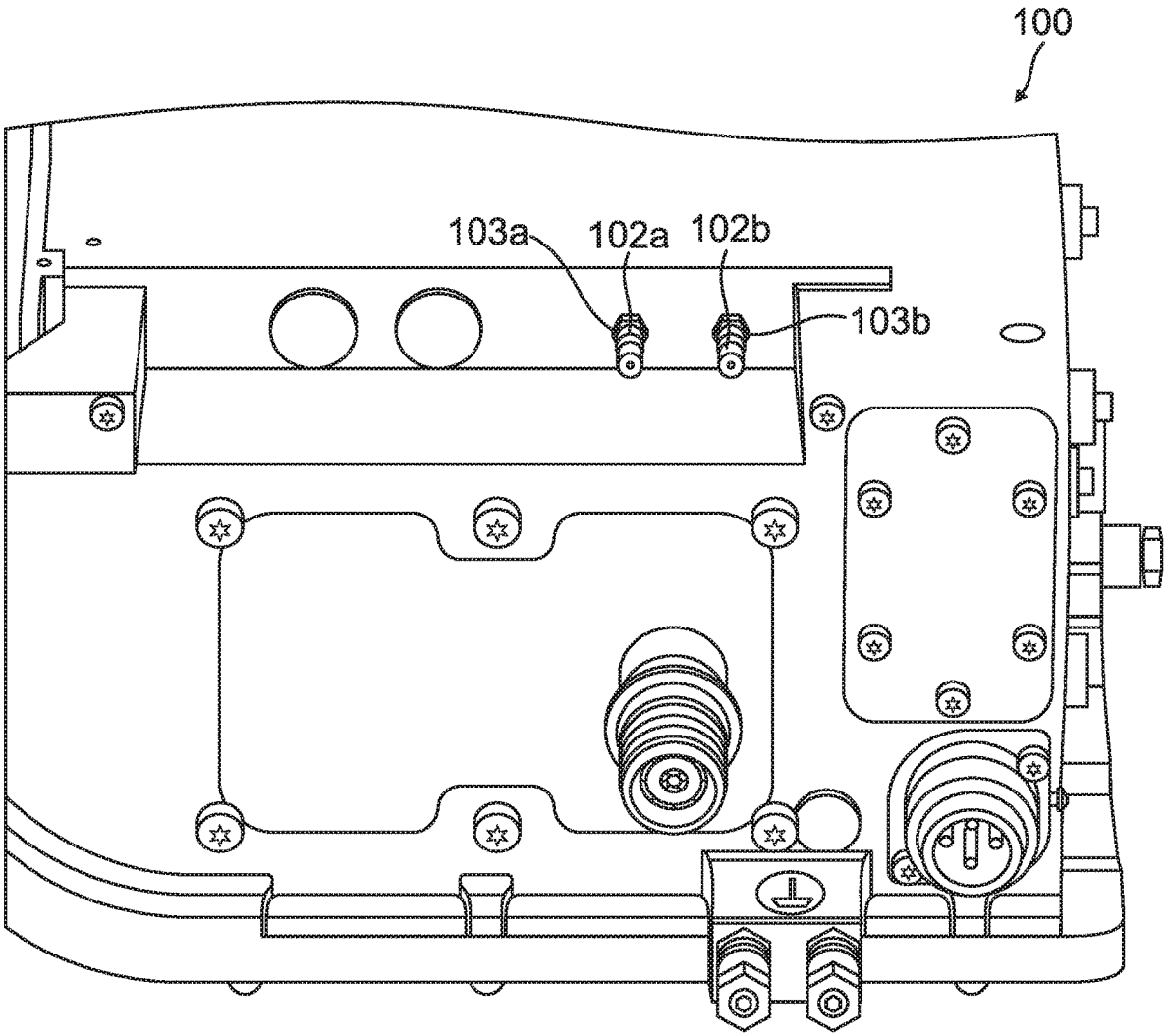
FIG. 1A (Prior Art)
FIG. 1A is a partial side perspective view of a remote antenna unit of the prior art

An example of a remote antenna unit 100 is illustrated in FIG. 1A. In particular, FIG. 1A illustrates a partial view of a remote antenna unit 100. Remote antenna unit 100 comprises downlink DAS circuitry that is configured to receive the downlink transport signals transmitted to it from one or more master units and to use the received downlink transport signals to generate one or more downlink radio frequency signals that are radiated from one or more coverage antennas associated with that remote antenna unit 100 for reception by user equipment such as cell phones. In this way, the DAS increases the coverage area for the downlink capacity provided by base stations.

Also, each remote antenna unit 100 may comprises uplink DAS circuitry that is configured to receive one or more uplink radio frequency signals transmitted from the user equipment. These signals are analog radio frequency signals. The uplink DAS circuitry in each remote antenna unit 100 may also be configured to generate one or more uplink transport signals derived from the one or more remote uplink radio frequency signals and to transmit one or more uplink transport signals to one or more of the master units.

The remote unit 100 of FIG. 1A includes a pair of expansion ports that in one embodiment includes component connectors 102*a* and 102*b*. In one embodiment, the component connectors 102*a* and 102*b* are used to connect an external notch filter on uplink bands in order to upgrade on field systems or install greenfield systems in combination with remote antenna unit public safety units.

Figure 1B:
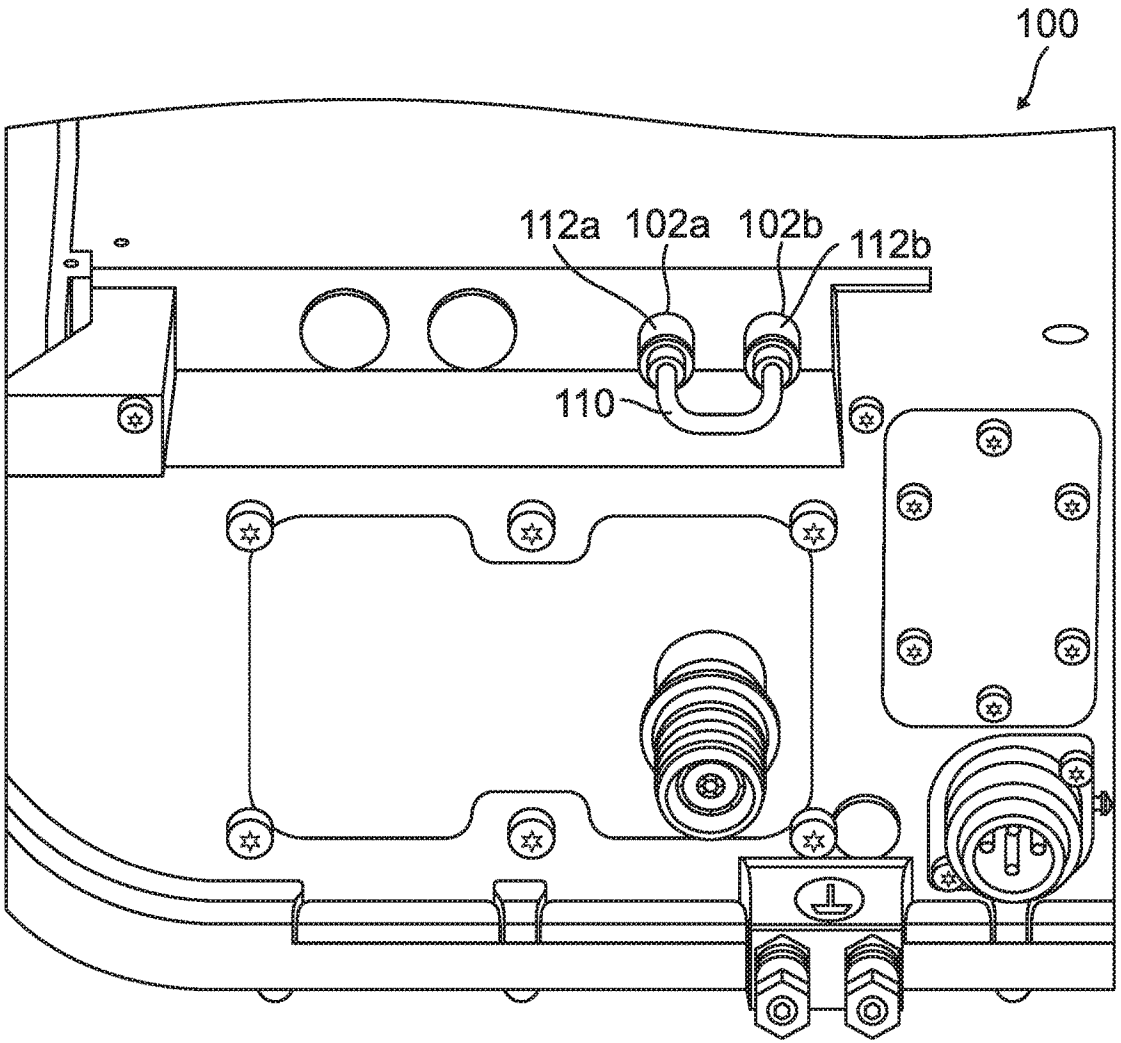
FIG. 1B (Prior Art)
FIG. 1B is the partial side perspective view of the remote antenna unit of FIG. 1A including a U-turn cable.
Figure 2:
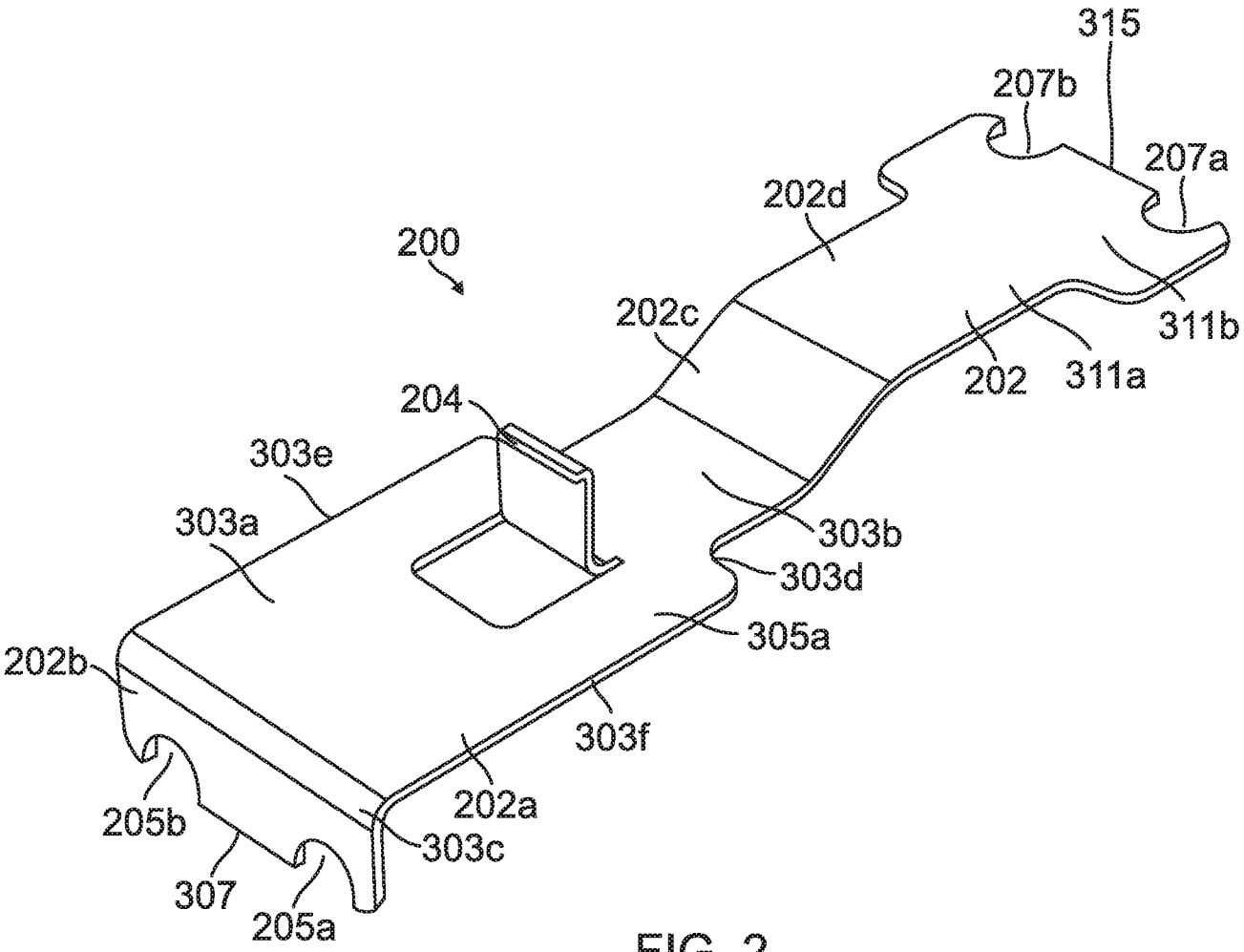
FIG. 2 is a side perspective view of a tool according to one exemplary embodiment.

The component connectors 102*a* and 102*b*, in an embodiment, are female waterproof RF bulkhead connectors 102*a* and 102*b*, such as QMA bulkhead connectors that include respective retaining nuts 103*a* and 103*b*. In one embodiment, the component connectors 102*a* and 102*b* are used to selectively connect an external notch filter for an uplink RF band handled by the remote antenna unit. In such an embodiment, the component connectors 102*a* and 102*b* are designed to enable an external notch filter to be placed in the signal path of the uplink RF band by connecting the external notch filter to the connectors 102*a* and 102*b*. If the application does not require a notch filter to be placed in the signal path, the signal path is closed by connecting a U-turn cable 110 (without a notch filter) to the connectors 102*a* and 102*b* as illustrated in FIG. 1B. Each end of the U-turn cable 110 terminates with a cable connector 112*a* and 112*b*, such as male QMA connectors. The cable connectors 112*a* and 112*b* are designed to selectively mate with the associated component connectors 102*a* and 102*b* to close the associated uplink signal path.

For performance and environmental requirements, the U-turn cable 110 is designed to be a semi-rigid cable. In one example, the semi-rigid U-turn cable has a 0.141 inch diameter. Due to the low flexibility of the semi-ridge U-turn cable 110, the two cable connectors 112*a* and 112*b* of the U-turn cable 110 need to be connected to and disconnected from the respective component connectors 102*a* and 102*b* at the "same" time. That is, the cable connectors 112*a* and 112*b* of the U-turn cable 110 should either both be connected to, or both be disconnected from, the component connectors 102*a* and 102*b*. One connector 112*a* or 112*b* should not be connected to one of the component connectors 102 or 102*b* while the other connector 112*a* or 112*b* is not connected to other component connector 102*a* or 102*b*. Otherwise damage, such as a break in the U-turn cable 110, may occur.

One embodiment of a tool 200 that can be used to connect or disconnect the two cable connectors 112*a* and 112*b* of the U-turn cable 110 to or from the respective component connectors 102*a* and 102*b* at the same time is illustrated in FIG. 2 and FIGS. 3A through 3C. Features of the tool 200 include a portion of the tool 200 that is generally L shaped and two spaced working end edges. This configuration enables the tool 200 to be used to connect and disconnect the U-turn cable 110 when the remote antenna unit 100 is mounted in different configurations. For example, the end of the tool 200 with the portion that is generally L-shaped may be used to connect and disconnect the cable 110 when the remote antenna unit 100 is installed in a dual wall mounting bracket in a rear position with a main heatsink on the wall side. The end of the tool 200 with a generally straight portion may be used disconnect the cable 110 when the remote antenna unit is installed in a single unit wall mounting bracket or in a dual mounting bracket in a front positon with a main heatsink on a front side.

Figure 3A:
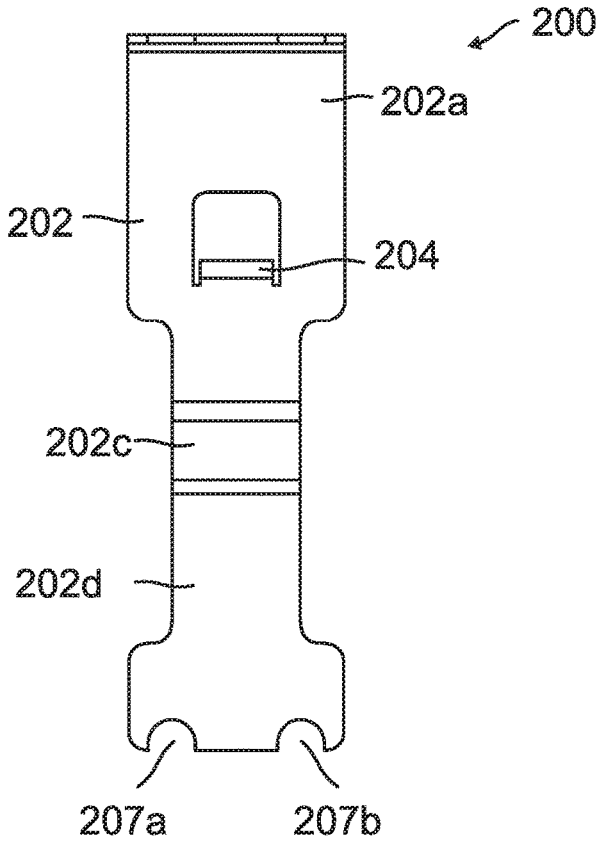
FIG. 3A is a top view of the tool of FIG. 2.
Figure 3B:
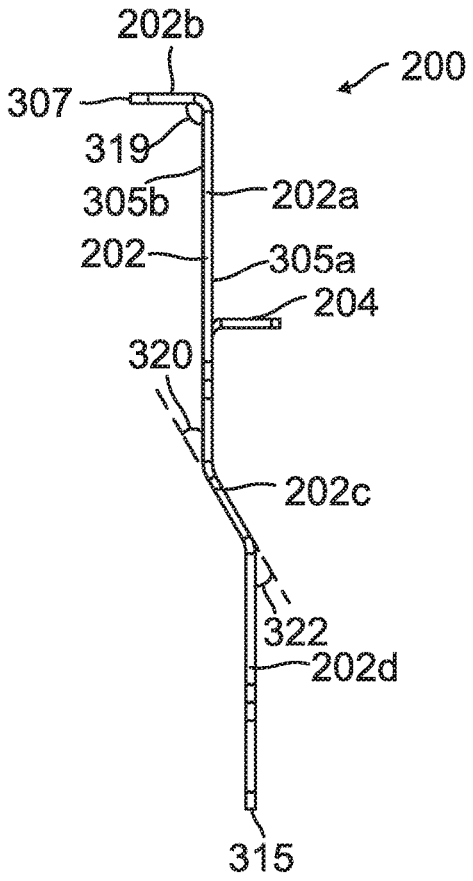
FIG. 3B is a side view of the tool of FIG. 2.
Figure 3C:
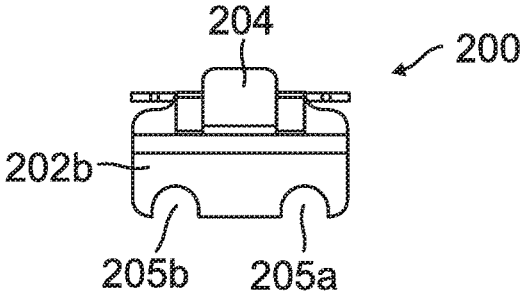
FIG. 3C is an end view of the tool of FIG. 2.

The tool 200 includes a body 202. The body 202, in an embodiment, is formed from a thin plate structure with a ridged composition. The body 202 includes a first body section 202*a* having a first portion 303*a* and a second portion 303*b*. The first portion 303*a* of the first body section 202*a* of the embodiment of FIG. 2 has a width that is wider than the respective width of the second portion 303*b* of the first body section 202*a*. The second portion 303*b* extends from an end 303*d* of the first portion 303*a*. An engaging flange 204 (or tab) extends from a first surface 305*a* of the first portion 303*a* in a generally perpendicular fashion. In the embodiment shown the FIGS. 2 and 3A through 3C, the engaging flange 204 is generally centered between side edges 303*e* and 303*f* that define the width of the first portion 303*a* of the first body section 202*a* and near the end 303*d* of the first portion 303*a*. The first surface 305*a* and second surface 305*b* of the tool are best illustrated in FIG. 3B.

Extending at a select angle 319 from the first body section 202*a* at a first end 303*c* of the first body section 202*a* is a second body section 202*b*. In one embodiment, the select angle is a right angle. The second body section 202*b* extends from the first body section 202*a* in an opposite direction than the engaging flange 204 extends from the first body section 202*a*. The second body section 202*b* terminates in a second body section end edge 307. Formed in this first edge 307 are a first pair of spaced guide grooves 205*a* and 205*b*. The first pair of spaced guide grooves 205*a* and 205*b* are shaped to be received around portions of the component connectors 102*a* and 102*b* and around portions of the U-turn cable 110 when either disconnecting or connecting the cable connectors 112*a* and 112*b* of the U-turn cable 110 from or to, respectively, the component connectors 102*a* and 102*b* as discussed in detail below. The spaced guide grooves 205*a* and 205*b* help guide the tool 200 to be positioned in a desired location to achieve the simultaneous disconnection or connection of the cable connectors 112*a* and 112*b* from or to, respectively, the component connectors 102*a* and 102*b*.

The tool 200 further includes a third body section 202*c* that is positioned between the second portion 303*b* of the first body section 202*a* and a fourth body section 202*d*. The third body section 202*c* extends at a select angle 320 into the first body section 202*a*. Further, the third body section 202*c* extends into the fourth body section 202*d* at a select angle 322. In one embodiment, these two angles 320 and 322 are equal to each other but are arranged in opposite directions so the first body section 202*a* is positioned in a parallel plane arrangement with the fourth body section 202*d*. For example, in one example embodiment, the both angles 320 and 322 are 30 degrees and are arranged to be in opposing directions. This is best illustrated in FIG. 3B where the third body section 202*c* generally provides a jog in the body 202 of the tool 200.

The fourth body section 202*d* includes a first portion 311*a* and a second portion 311*b*. The first portion 311*a* of the fourth body section 202*d* of the embodiment shown in FIG. 2 has a width that is narrower than a width of the second portion 311*b* of the fourth body section 202*d*. In one embodiment the width of the second portion 311*b* of the fourth body section 202*d* is substantially equal to the width of the first portion 303*a* of the first body section 202*a* as best illustrated in FIG. 3A. The second portion 311*b* of the fourth body section 202*d* terminates in a section end edge 315. Formed in this second edge 315 of the fourth body section 202*d* are a second pair of spaced guide grooves 207*a* and 207*b*. The second pair of spaced guide grooves 207*a* and 207*b* are shaped to be received around portions of the component connectors 102*a* and 102*b* and around portions of the U-turn cable 110 when disconnecting or connecting the U-turn cable 110 from or to, respectively, the bulkhead connectors 102*a* and 102*b* as discussed in detail below. Hence, the tool 200 includes two pairs of the spaced guide grooves 205*a*, 205*b* and 207*a*, 207*b* that are positioned at different locations and orientations with respect to each other.

Figure 4:
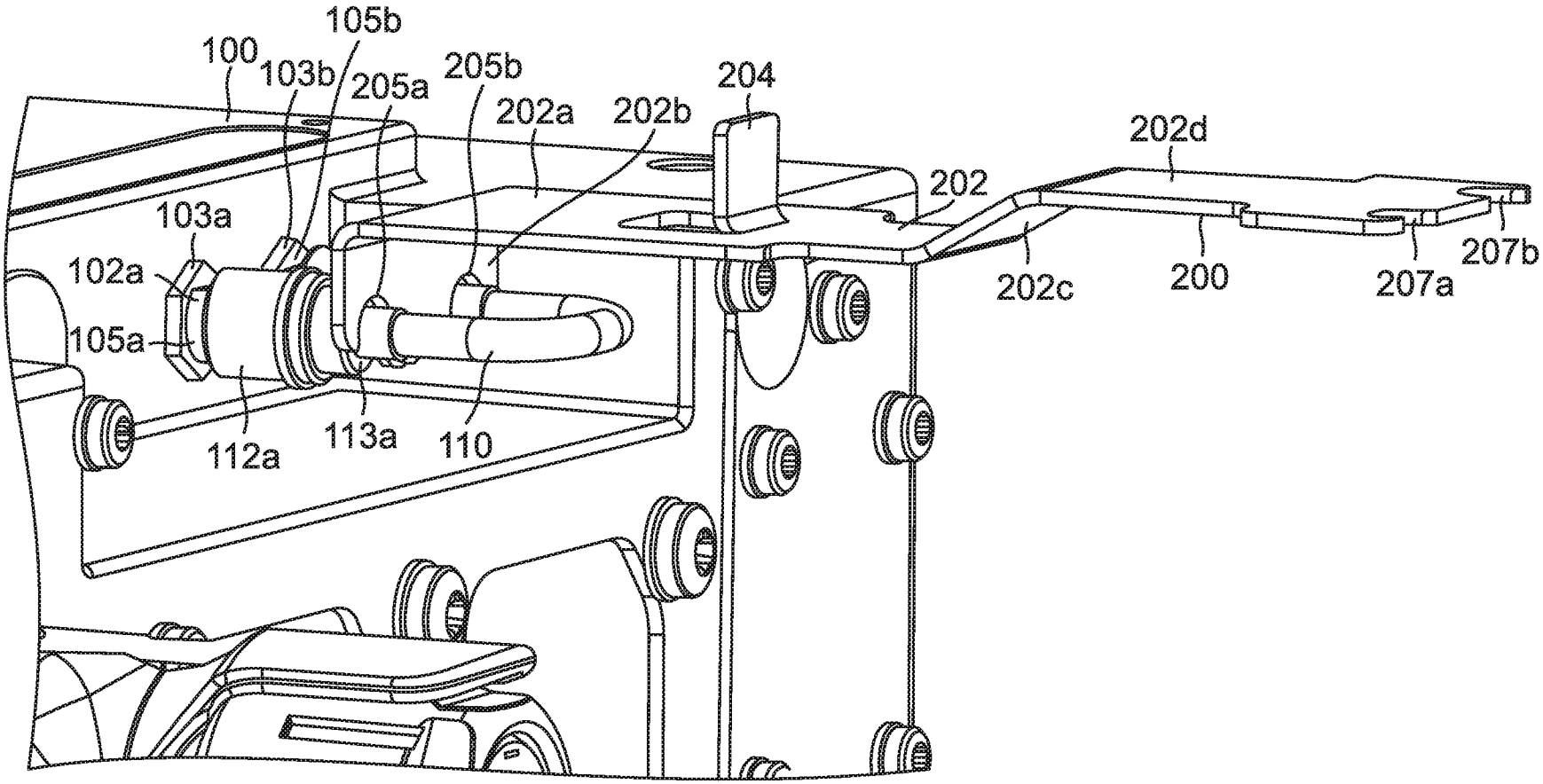
FIG. 4 is a side perspective view of the tool of FIG. 2 positioned to simultaneously cause cable connectors of a U-turn cable to engage component connectors according to one exemplary embodiment.

FIG. 4 illustrates the tool 200 being used to connect a U-turn cable 110 to the component connectors 102*a* and 102*b* of the remote antenna unit 100. In particular, when a U-turn cable 110 is to be connected to the ports (component connectors 102*a* and 102*b* in an embodiment), the cable connectors 112*a* and 112*b* are aligned to be connected to the respective component connectors 102*a* and 102*b*. The tool 200 is then positioned so that the spaced guide grooves 205*a* and 205*b* in the section end edge 307 of the second body section 202*b* are positioned partially around portions of the U-turn cable 110 near the respective cable connectors 112*a* and 112*b* of the U-turn cable 110. The first surface 305*a* proximate the spaced guide grooves 205*a* and 205*b* of the second body section 202*b* of the tool 200 is further positioned to engage respective inner connector edges 113*a* and 113*b* of the cable connectors 112*a* and 112*b* of the U-turn cable 110 when connecting the cable connector 112*a* and 112*b* to the component connectors 102*a* and 102*b*. Once the tool 200 is in positon, the technician may use the engaging flange 204 to assert a force on the tool to push the cable connectors 112*a* and 112*b* into the respective component connectors 102*a* and 102*b* of the remote antenna unit to simultaneously establish a communication connection between the cable connectors 112*a* and 112*b* and the respective component connectors 102*a* and 102*b*.

Figure 5:
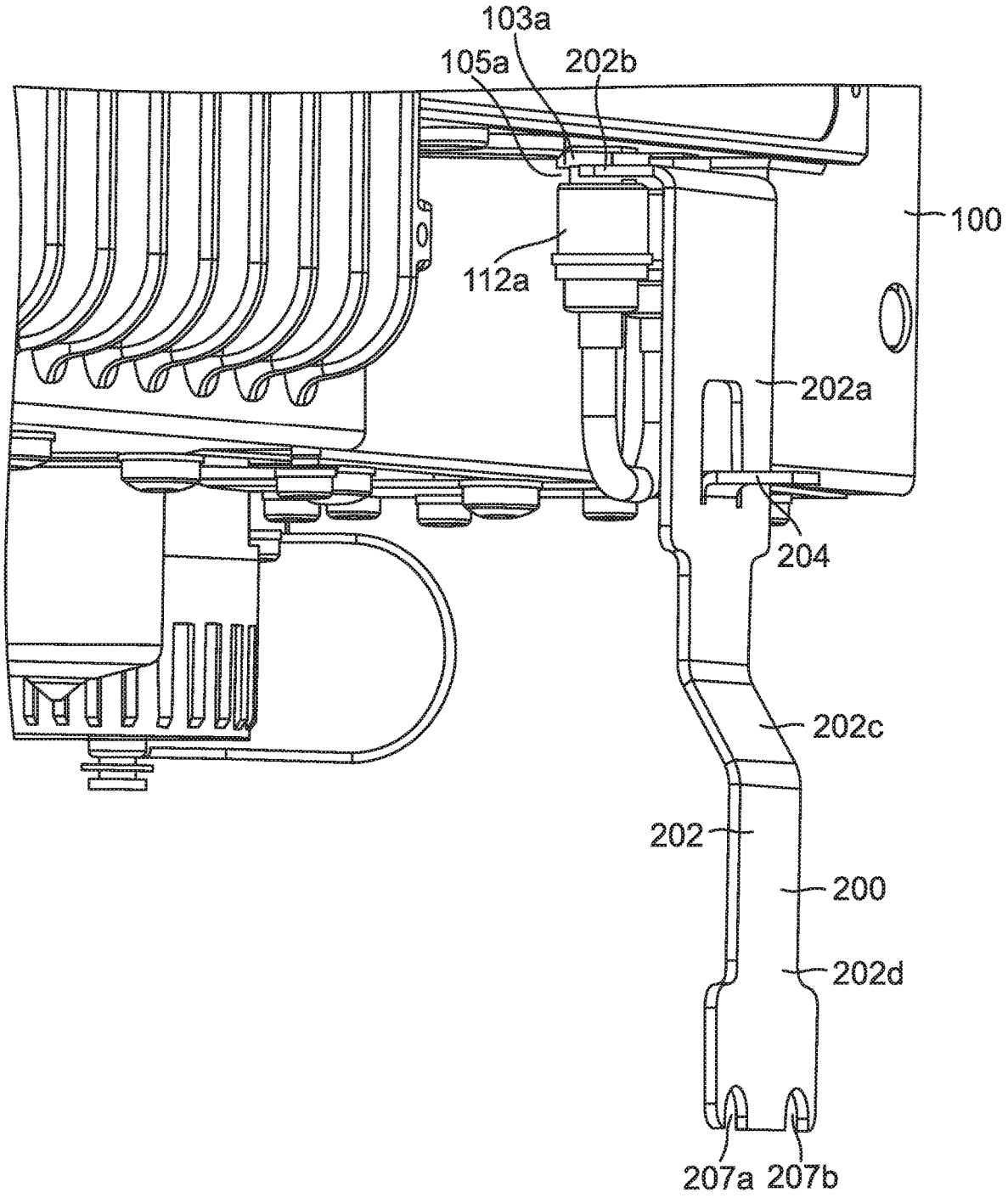
FIG. 5 is a side perspective view of the tool of FIG. 2 positioned to simultaneously cause the cable connectors of a U-turn cable to disengage the component connectors according to one exemplary embodiment.

FIG. 5 illustrates the tool 200 in one possible orientation while positioned to remove the cable connectors 112*a* and 112*b* from the respective component connectors 102*a* and 102*b*. With the tool 200 in this orientation, at least a portion of the second body section 202*b* is positioned between connected gaps 105*a* and 105*b* between the cable connectors 112*a* and 112*b* and their respective component connectors 102*a* and 102*b*. In particular, the gaps 105*a* and 105*b* in this example, are between each retaining nut 103*a* and 103*b* of the respective bulkhead connectors 102*a* and 102*b* and a terminal end of each associated cable connector 112*a* and 112*b*. With the tool 200 positioned as illustrated in FIG. 5, the first pair of spaced guide grooves 205*a* and 205*b* in the section end edge 307 of the second body section 202*b* of the tool 200 are received around portions of the respective component connectors 102*a* and 102*b*. To disconnect the cable connectors 112*a* and 112*b* from their respective component connectors 102*a* and 102*b*, the technician simply has to pull on the tool 200 away from the component connectors 102*a* and 102*b* or apply side pressure on or near the fourth body section 202*d* of the tool 200 to pry the cable connectors 112*a* and 112*b* away from their respective component connectors 102*a* and 102*b*. Pressure on the terminal ends of the cable connectors 112*a* and 112*b* by the surface 305*a* of the second body section 202*b* of the tool 200 due to the manipulation of the tool 200 as described above simultaneously disconnects the cable connectors 112*a* and 112*b* from their respective connectors 102*a* and 102*b*.

Figure 6:
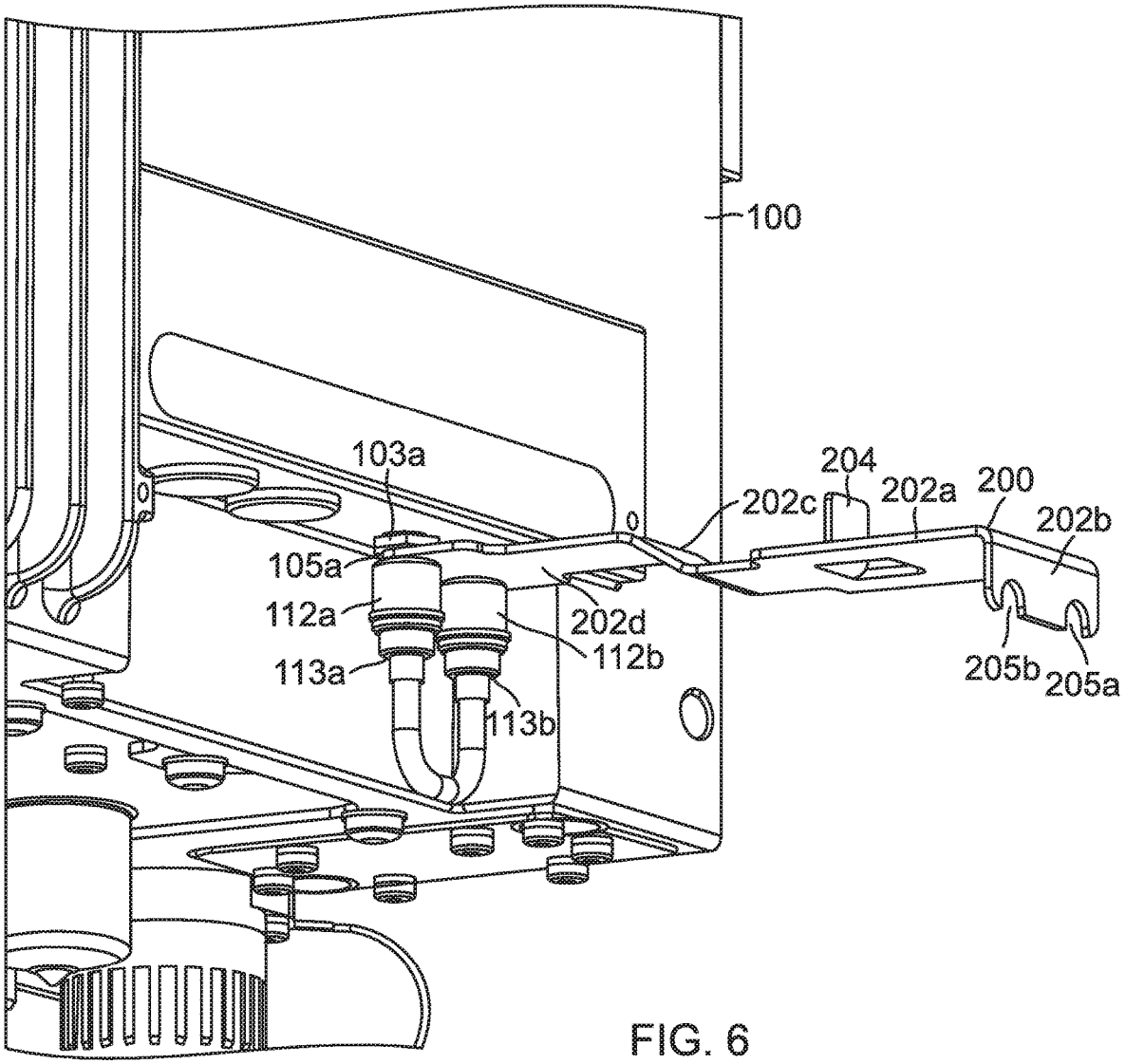
FIG. 6 is a side perspective view of the tool of FIG. 2 positioned to simultaneously cause the cable connectors of a U-turn cable to disengage the component connectors according to another exemplary embodiment.

FIG. 6 illustrates the tool 200 orientated in a different manner where the second pair of spaced guide grooves 207*a* and 207*b* in the section end edge 315 of the fourth body section 202*d* of the tool 200 are positioned between connected gaps 105*a* and 105*b* between the cable connectors 112*a* and 112*b* and their respective component connectors 102*a* and 102*b*. With the tool orientated this way, a force that is applied generally orthogonal to the first body section 202*a* of the tool 200 about the first and second surfaces 305*a* and 305*b* causes portions of the fourth body section 202*d* near the spaced guide groves 207*a* and 207*b* to pry the cable connectors 112*a* and 112*b* away from their respective component connectors 102*a* and 102*b*. Hence, as illustrated in FIGS. 5 and 6, either end of the tool 200 can be used to simultaneously disconnect the cable connectors 112*a* and 112*b* from the component connectors 102*a* and 102*b*.

Example Embodiments

Example 1 is a tool for connecting and disconnecting a pair of connectors. The tool has a body. The body includes a first edge that is spaced from a second edge. A first portion of the body that includes the first edge is positioned at a first angle in relation to a second portion of the body that includes the second edge. The first edge has a first pair of spaced guide grooves and the second edge has a second pair of spaced guide grooves. The first pair of spaced grooves and the second pair of spaced grooves are configured to selectively receive portions of a cable and portions of component connectors.

Example 2, includes the tool of Example 1, wherein the first angle between the first portion of the body and the second portion of the body is a right angle Example 3 includes the tool of any of the Examples 1-2, further including an engaging flange that extends from a surface of the body. The engaging flange provides a surface to manipulate the tool.

Example 4 includes the tool of any of the Examples 1-3, wherein the body further includes a first body section, a second body section, third body section and a fourth body section. The second body section extends from a first end of the first body section at the first angle. The second body section includes the first portion of the body. The third body section extends from a second end of the first body section at a second angle. The fourth body section extends from the third body section at a third angle. The fourth body section includes the second portion of the body.

Example 5 includes the tool of Example 4, further including an engaging flange that extends from a surface of the first body section of the body. The engaging flange provides a surface to manipulate the tool. Further the engaging flange extends in an opposite direction from the first body section than the second body section extends from the first body section.

Example 6 includes the tool of Example 4, wherein the second angle and third angle are selected so the first body section and the second body section are in parallel planes.

Example 7 includes the tool of Example 4, wherein the first body section includes a first portion having a first width and a second portion having a different second width.

Example 8 includes the tool of Example 7, wherein the fourth body section includes a first portion having a first width and a second portion having a different second width.

Example 9 includes the tool of Example 8, wherein the first width of the first portion of the first body section is equal to the second width of the second portion of the fourth body section and the second width of the second portion of the first body section is equal to the first width of the first portion of the fourth body section.

Example 10 is a tool for connecting and disconnecting a U-turn cable from a component. The tool includes a body. The body includes a first edge that is spaced from a second edge. A first portion of the body that includes the first edge is positioned at a select first angle in relation to a second portion of the body that includes the second edge. The first edge has a first pair of spaced guide grooves. The second edge has a second pair of spaced guide grooves. The first pair of spaced grooves and the second pair of spaced grooves are configured to selectively receive portions of a cable of the U-turn cable and portions of component connectors. An engaging flange extends from a surface of the body. The engaging flange provides a surface to manipulate the tool.

Example 11 includes the tool of Example 10, wherein the body further includes a first body section, a second body section, a third body section and a fourth body section. The second body section extends from a first end of the first body section at the first angle. The second body section includes the first portion of the body. The third body section extends from a second end of the first body section at a second angle. The fourth body section extends from the third body section at a third angle. The fourth body section includes the second portion of the body.

Example 12 includes the tool of Example 11, wherein the engaging flange extends from a surface of the first body section of the body in an opposite direction from the first body section than the second body section extends from the first body section.

Example 13 includes the tool of Example 12, wherein the engaging flange extends a right angle from the first body section and the second body section extends at a right angle from the first body section.

Example 14 includes the tool of any of the Examples 11-13, wherein the second angle and the third angle are selected so the first body section and the second body section are in parallel planes.

Example 15 includes the tool of any of the Examples 11-14, further wherein the first body section includes a first portion having a first width and a second portion having a different second width and the fourth body section includes a first portion having a first width and a second portion having a different second width.

Example 16 includes the example of claim 15, wherein the first width of the first portion of the first body section is equal to the second width of the second portion of the fourth body section and the second width of second portion of the first body section is equal to the first width of the first portion of the fourth body section.

Example 17 includes a method of manipulating a U-turn cable having a pair of cable connectors, the method includes when coupling the pair of cable connectors to an associated pair of component connectors of a component, aligning each cable connector of the pair of cable connectors with an associated component connector of the pair of component connectors; positioning a pair of spaced guide grooves in an end edge of a tool around portions of the U-turn cable near the pair of cable connectors; and asserting a force on the tool towards the cable connectors to simultaneously engage and force connecting portions of the cable connectors to establish a communicative coupling with associated connecting portions of the component connectors.

Example 18 includes the method of Example 17, further including when decoupling the pair of cable connectors of the U-turn cable from the associated pair of component connectors of the component, positioning the pair of spaced guide grooves in the end edge of the tool around portions of the pair of component connectors within a space between the component and the cable connectors; and asserting a force on the tool to simultaneously pry the connecting portions of the cable connectors from the connecting portions of the component connectors to break the communitive coupling and remove the pair of cable connectors from the component connectors.

Example 19 includes the method of Example 17, wherein asserting a force on the tool towards the cable connectors to simultaneously engage and force connecting portions of the cable connectors to establish a communicative coupling with associated connecting portions of the component connectors further includes asserting a force on an engaging flange of the tool.

Example 20 includes the method of any of the Examples 17-20, wherein the component is a remote antenna unit, the pair of component connectors are a pair of female quick connect radio frequency (RF) bulkhead connectors and the pair cable connectors are a pair of male quick connect RF cable connectors.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A tool for connecting and disconnecting a pair of connectors, the tool comprising:

a body including a first edge that is spaced from a second edge, a first portion of the body that includes the first edge being positioned at a first angle in relation to a second portion of the body that includes the second edge;

the first edge having a first pair of spaced guide grooves; and the second edge having a second pair of spaced guide grooves, the first pair of spaced grooves and the second pair of spaced grooves being configured to selectively receive portions of a cable and portions of component connectors.

2. The tool of claim 1, wherein the first angle between the first portion of the body and the second portion of the body is a right angle.

3. The tool of claim 1, further comprising:

an engaging flange extending from a surface of the body, the engaging flange providing a surface to manipulate the tool.

4. The tool of claim 1, wherein the body further comprises:

a first body section;

a second body section extending from a first end of the first body section at the first angle, the second body section including the first portion of the body;

a third body section extending from a second end of the first body section at a second angle;

a fourth body section extending from the third body section at a third angle, the fourth body section including the second portion of the body.

5. The tool of claim 4, further comprising:

an engaging flange extending from a surface of the first body section of the body, the engaging flange providing a surface to manipulate the tool, the engaging flange extending in an opposite direction from the first body section than the second body section extends from the first body section.

6. The tool of claim 4, wherein the select second angle and third angle are selected so the first body section and the second body section are in parallel planes.

7. The tool of claim 4, wherein the first body section includes a first portion having a first width and a second portion having a different second width.

8. The tool of claim 7, wherein the fourth body section includes a first portion having a first width and a second portion having a different second width.

9. The tool of claim 8, wherein the first width of the first portion of the first body section is equal to the second width of the second portion of the fourth body section and the second width of the second portion of the first body section is equal to the first width of the first portion of the fourth body section.

10. A tool for connecting and disconnecting a U-turn cable from a component, the tool comprising:

a body including a first edge that is spaced from a second edge, a first portion of the body that includes the first edge being positioned at a first angle in relation to a second portion of the body that includes the second edge;

the first edge having a first pair of spaced guide grooves;

the second edge having a second pair of spaced guide grooves, the first pair of spaced grooves and the second pair of spaced grooves being configured to selectively receive portions of a cable of the U-turn cable and portions of component connectors; and an engaging flange extending from a surface of the body, the engaging flange providing a surface to manipulate the tool.

11. The tool of claim 10, wherein the body further comprises:

a first body section;

a second body section extending from a first end of the first body section at the first angle, the second body section including the first portion of the body;

a third body section extending from a second end of the first body section at a second angle;

a fourth body section extending from the third body section at a third angle, the fourth body section including the second portion of the body.

12. The tool of claim 11, wherein the engaging flange extends from a surface of the first body section of the body in an opposite direction from the first body section than the second body section extends from the first body section.

13. The tool of claim 12, wherein the engaging flange extends at a right angle from the first body section and the second body section extends at a right angle from the first body section.

14. The tool of claim 11, wherein the second angle and the third angle are selected so the first body section and the second body section are in parallel planes.

15. The tool of claim 11, further wherein:

the first body section includes a first portion having a first width and a second portion having a different second width; and the fourth body section includes a first portion having a first width and a second portion having a different second width.

16. The tool of claim 15, wherein the first width of the first portion of the first body section is equal to the second width of the second portion of the fourth body section and the second width of second portion of the first body section is equal to the first width of the first portion of the fourth body section.

17. A method of manipulating a U-turn cable having a pair of cable connectors, the method comprising:

when coupling the pair of cable connectors to an associated pair of component connectors of a component, aligning each cable connector of the pair of cable connectors with an associated component connector of the pair of bulkhead connectors;

positioning a pair of spaced guide grooves in an edge of a tool around portions of the U-turn cable near the pair of cable connectors; and asserting a force on the tool towards the cable connectors to simultaneously engage and force connecting portions of the cable connectors to establish a communicative coupling with associated connecting portions of the component connectors.

18. The method of claim 17, further comprising:

when decoupling the pair of cable connectors of the U-turn cable from the associated pair of component connectors of the component, positioning the pair of spaced guide grooves in the edge of the tool around portions of the pair of component connectors within a space between the component and the cable connectors; and asserting a force on the tool to simultaneously pry the connecting portions of the cable connectors from the connecting portions of the component connectors to break the communitive coupling and remove the pair of cable connectors from the component connectors.

19. The method of claim 17, wherein asserting a force on the tool towards the cable connectors to simultaneously engage and force connecting portions of the cable connectors to establish a communicative coupling with associated connecting portions of the component connectors further comprises:

asserting a force on an engaging flange of the tool.

20. The method of claim 17, wherein the component is a remote antenna unit, the pair of component connectors are a pair of female quick connect radio frequency (RF) bulkhead connectors and the pair cable connectors are a pair of male quick connect RF cable connectors.

* * * * *